United States Patent [19]

Charles

[11] 4,320,553

[45] Mar. 23, 1982

[54] PAINT ROLLER ASSEMBLY

[76] Inventor: Robert T. Charles, 634 N. Kingsley Dr., Los Angeles, Calif. 90004

[21] Appl. No.: 157,256

[22] Filed: Jun. 9, 1980

[51] Int. Cl.[3] ..... B05C 17/02

[52] U.S. Cl. ..... 15/230.11

[58] Field of Search ..... 15/230.11; 401/118

[56] References Cited

U.S. PATENT DOCUMENTS

| | | | |
|---|---|---|---|
| 2,652,774 | 9/1953 | Sprung | 15/230.11 X |
| 3,085,270 | 4/1963 | Vosbikian | 15/230.11 X |
| 3,130,435 | 4/1964 | Smith | 15/230.11 |
| 3,205,526 | 9/1965 | Archibald | 15/230.11 |
| 3,241,175 | 3/1966 | Johnson | 401/118 |
| 3,409,929 | 11/1968 | Fisher | 15/230.11 X |
| 4,000,537 | 1/1977 | Woo | 15/230.11 |

FOREIGN PATENT DOCUMENTS

| | | | |
|---|---|---|---|
| 1106159 | 7/1955 | France | 15/230.11 |

*Primary Examiner*—Billy J. Wilhite

*Attorney, Agent, or Firm*—Fulwider, Patton, Rieber, Lee & Utecht

[57] ABSTRACT

A paint roller assembly includes three paint rollers mounted in a mutually parallel relation on a support frame. Two of the rollers are spaced from each other, and are positioned on the frame for rolling engagement with a surface to be coated with paint. A third roller is carried in rolling engagement with the other two rollers for preventing splatter of paint from the rollers, and for distributing paint between the rollers. A handle member is pivotally joined to the support frame by a friction clutch assembly for applying an adjustable frictional force to resist pivoting motion of the handle member.

15 Claims, 5 Drawing Figures

PAINT ROLLER ASSEMBLY

BACKGROUND OF THE INVENTION

This invention relates to paint rollers. More specifically, this invention relates to an improved paint roller assembly including a plurality of roller members designed for rapid coverage of a surface to be coated with paint with a minimum number of strokes and with little or no splatter of paint.

A variety of paint roller assemblies are available throughout the prior art. Such paint roller assemblies typically comprise a pivoting handle member coupled to a roller member for rolling motion over a surface for application and smoothing of paint thereon. Many of these prior art roller assemblies include a single roller member, such as that shown in U.S. Pat. No. 3,241,175. Other prior art paint roller devices have a handle member attached to a plurality of roller members or the like for purposes of reducing the number of strokes required to cover a surface with paint, and for improving the ability of the roller to apply paint to small areas, such as corners. See, for example, U.S. Pat. Nos. 2,652,774; 3,130,435; 3,205,526; 3,085,270; 3,409,929; and 4,000,537. However, these prior art paint roller devices typically carry more paint than the more conventional devices with a single roller member, whereby splattering of the paint is a significant problem. While some of these multiple roller member devices have included shields and the like to reduce paint splatter, these prior art devices heretofore have not satisfactorily provided a splatter-free unit which is both relatively lightweight and easy to use.

Another problem encountered with prior art paint roller devices including multiple roller members is that their use tends to result in substantial user fatique. More specifically, in some devices, the roller members are freely pivoted with respect to the handle member. Since the multiple roller members carry a substantial quantity of paint, the roller members tend to be relatively unstable with respect to their pivot axis to require substantial manual effort to orient the pivotal roller members properly with respect to a surface to be painted. Alternately, some prior art devices seek to overcome this problem by securing the multiple roller members against pivoting motion with respect to the handle member. However, this requires orientation of the device at precisely the same attitude at all times with respect to the surface for proper application of paint to the surface. This requirement of consistency in the orientation of the device also contributes substantially to user fatique.

The present invention overcomes the problems and disadvantages of the prior art by providing an improved paint roller assembly having a plurality of rollers disposed for rolling engagement with each other and with a surface to be painted for high-quality application of paint to the surface with little or no paint splatter. Moreover, the paint roller assembly of this invention is designed to be relatively lightweight for ease of use, and to include a pivoting handle member arrangement adapted for reducing fatique during use.

SUMMARY OF THE INVENTION

In accordance with the invention, a paint roller assembly is provided with a plurality of rollers for rapid application of paint to a surface with a minimum number of strokes. The paint roller assembly includes means for substantially eliminating paint splatter from the rollers during use. Moreover, the rollers are carried by a support frame pivotally connected by a friction clutch assembly to a handle member, wherein the clutch assembly is adjustable to maintain the stability of the rollers with respect to the handle member and thereby minimize user fatique.

In one form of the invention, two rollers are carried on the support frame in spaced parallel relation for rolling contact with a surface to be painted. A third roller is carried for rolling contact with both of the two rollers on one side thereof generally opposite to the surface to be painted. This third roller functions to distribute paint between the two rollers and to prevent splattering and dripping of the paint from the roller assembly as the two rollers are moved over the surface to be painted.

The friction clutch assembly is connected between the roller support frame and a pivoting handle member, and is adjustable to apply a selected frictional resistance to the freedom of pivoting motion of the handle member with respect to the support frame. In this manner, the rollers are maintained on the support frame in a relatively stable position, and the handle member is allowed to pivotally swing with respect to the support frame during use to enable easy orientation of the two rollers in proper rolling engagement with the surface to be painted.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
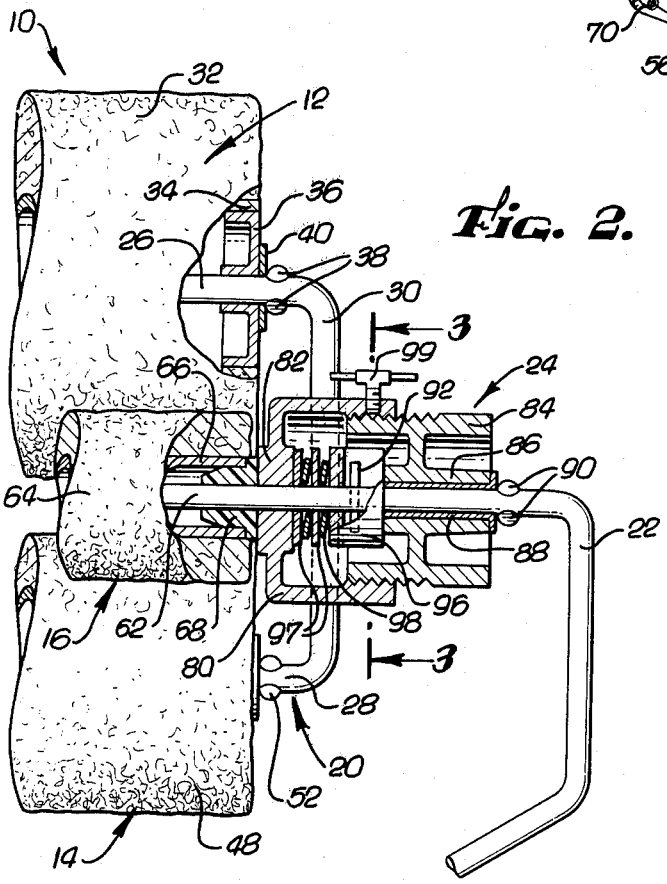
FIG. 1 is a perspective view of the paint roller assembly of this invention with a portion shown in exploded form.

As shown in the exemplary drawings, the present invention is embodied in a paint roller assembly having three paint rollers 12, 14 and 16 for use in rapid application of paint to a surface to be painted with a minimum number of strokes. The rollers 12, 14, and 16 are oriented on a support frame 20 with respect to each other to eliminate substantially the occurrence of splattering of paint during use. Moreover, the support frame 20 is coupled to a pivoting handle member 22 by means of a friction clutch assembly 24 which is adjustable to control pivoting motion of the handle member 22 with respect to the support frame 20, and thereby reduce user fatique. The paint roller assembly thus provides a substantial improvement over prior art devices by providing multiple rollers for rapid application of paint to a surface with minimum user fatique.

As illustrated in the drawings, the rollers 12 and 14 are mounted on the support frame 20 in parallel relation to each other, and spaced from each other for independent rolling contact with a surface to be painted. More specifically, the support frame 20 comprises a generally U-shaped rod formed from metal or the like to include a pair of parallel shafts 26 and 28 connected together at a common end by a transverse base 30. The roller 12 is received over the frame shaft 26 for rotation about the axis of the shaft 26, and the roller 14 is received over the frame shaft 28 for rotation about the axis of the shaft 28.

The roller 12 is formed from a relatively large diameter roll 32 of a suitable paint carrying fabric such as cotton or the like. The fabric roller 32 is secured, for example, by means of a suitable adhesive about a hollow cylinder 34 including a hub 36 (FIG. 2) adjacent the frame base 30. The hub 36 rotatably receives the frame shaft 26 and axially bears against pressed ears 38 on the shaft 26 to control axial excursions of the roller 12. Conveniently, if desired, a washer 40 may be interposed on the shaft 26 between the hub 36 and the pressed ears 38.

The opposite end of the cylinder 34 of the roller 12 carries a hub 42 (FIG. 5) which also rotatably receives the frame shaft 26. This latter hub 42 is configured for passage of the free end of the shaft 26 for a short distance in an outboard direction from the roller 12. This free end of the shaft 26 is then secured within a socket 44 of a bracket 46 to prevent the roller 12 from inadvertently slipping off the frame shaft 26. Alternately, other arrangements may be provided for securing the roller 12 for rotation on the frame shaft 26.

The roller 14 is formed from a roll 48 of a suitable paint-carrying fabric which is secured, for example, by a suitable adhesive to a hollow cylinder 50. This cylinder 50 is mounted for rotation about the other frame shaft 28 in generally the same manner as the roller 12 is mounted on the frame shaft 26. More specifically, the cylinder 50 includes a hub (not shown) adjacent the frame base in axially bearing engagement with pressed ears 52 on the frame shaft 28 and a hub 54 adjacent the free end of the shaft 28. The hub 54 is configured for passage of the shaft 28 for a short distance in an outboard direction from the roller 14, and the shaft 28 is secured within a socket 56 of the bracket 46.

Figure 4:
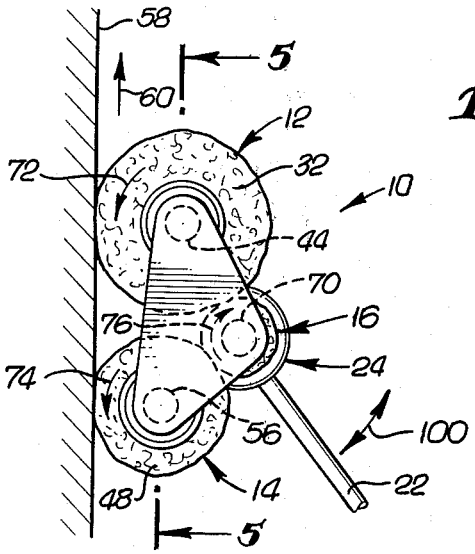
FIG. 4 is a reduced end view of the assembly illustrating engagement with a surface to be painted.

The fabric roll 48 of the roller 14 is sized to have a diameter somewhat smaller than the diameter of the fabric roll 32 of the roller 12. Accordingly, the roller 14 is formed to have a shorter nap than the roller 12. With this structure, the roller 12 comprises a so-called "rough coat" roller for carrying a large quantity of paint and for applying a substantial layer of the paint to a surface 58 when the assembly 10 is moved over the surface 58 in the direction of arrow 60 as illustrated in FIG. 4. The roller 14 comprises a "finish coat" roller for smoothing the applied paint layer to a finish surface texture.

In actual practice, the relatively large roller 12 may conveniently comprise a conventional rough-surface paint roller such as the type commonly used for painting stucco and other rough-textured surfaces. The smaller roller 14 may conveniently comprise a conventional smooth surface paint roller of the type commonly used for applying a finish surface texture in a typical household environment.

The third roller 16 is positioned in parallel rolling contact with the two rollers 12 and 14 to distribute paint between the two rollers 12 and 14, and to substantially eliminate splatter of paint from the assembly 10 during use. More specifically, the third roller 16 is positioned for rotation about a third frame shaft 62 which also is formed from a rod of metal or the like and extends in parallel with the other frame shafts 26 and 28 generally at one side of a plane common to the other shafts 26 and 28. With this configuration, the third roller 16 is disposed in rolling engagement with the other two rollers 12 and 14 generally at the side of the rollers 12 and 14 opposite the surface 58 to be painted.

Figure 2:
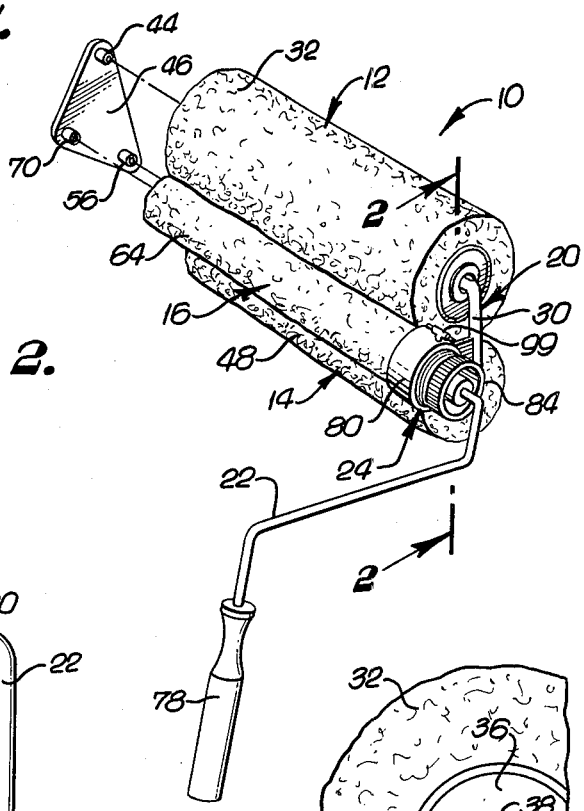
FIG. 2 is an enlarged fragmented view of the assembly with portions broken away.

As illustrated in FIG. 2, the third roller comprises a roll 64 of a suitable paint-carrying fabric. This roll 64 has a length generally corresponding to the lengths of the rollers 12 and 14, and is secured for example by a suitable adhesive about a relatively small diameter hollow cylinder 66. The cylinder 66 receives a bushing 68 at its end adjacent the friction clutch assembly 24, and this bushing 68 bears axially against the friction clutch assembly to prevent axial excursion of the roller 16.

Figure 5:
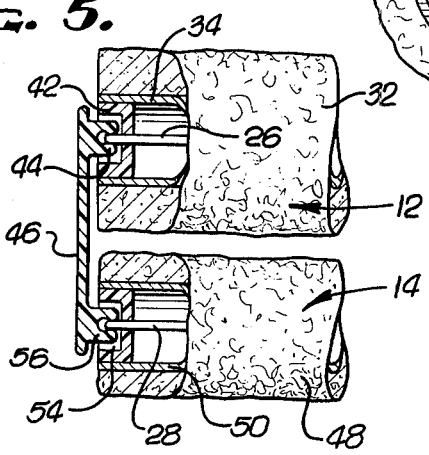
FIG. 5 is a fragmented view of a portion of the assembly with portions broken away.

The opposite end of the cylinder 66 of the third roller 16 receives a hub (not shown) which is appropriately sized and is configured generally consistent with the hubs 42 and 54 shown in FIG. 5 for passage of the free end of the shaft 62. The shaft 62 in turn is fixed within a third socket 70 of the bracket 46. Thus, as can be seen from FIGS. 1, 4, and 5, the bracket 46 comprises a convenient means for maintaining the free ends of the frame shafts 26, 28, and 62 in constant, spaced parallel relation to each other. Of course, the bracket 46 is removable to allow rapid and easy replacement of the various rollers when required.

In use, as illustrated in FIG. 4, motion of the roller assembly 10 over the surface 58 to be painted in the direction of the arrow 60 causes the two rollers 12 and 14 to rotate about their respective shafts 26 and 28 in a counterclockwise direction as shown by arrows 72 and 74. The third roller 16, however, is thus caused to rotate about its associated shaft 62 in a clockwise direction as shown by arrow 76. In this manner, paint carried by the large roller 12 is applied to the surface 58. Any excess paint on the roller 12 is carried directly into engagement with the third roller 16 to eliminate substantially all paint splatter. This excess paint is then carried by the third roller 16 directly to the lower finish roller 14 for application to the surface 58.

The support frame 20 is connected to the handle member 22 through the friction clutch assembly 24 which is adjustable to apply a controlled frictional force resisting pivoting movement of the handle member 22 with respect to the rollers 12, 14, and 16. More specifically, as illustrated by way of example in FIG. 2, the third frame shaft 62 conveniently projects axially from the third roller 16 through the friction clutch assembly 24, and then turns downwardly to form the handle member 22. This handle member 22 is generally conventional in shape, and includes a handgrip 78 for ease of manual grasping.

Figure 3:
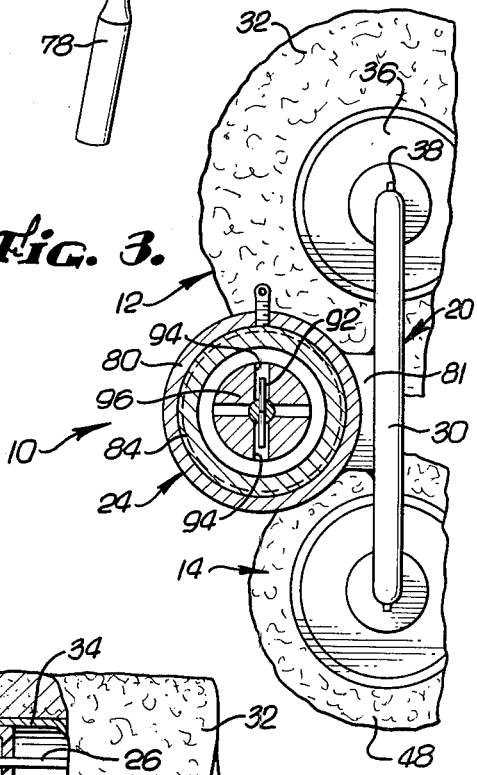
FIG. 3 is a fragmented vertical section taken on the line 3—3 of FIG. 2.

The friction clutch assembly 24 comprises a cup-shaped female member 80 secured for example by welds 81 (FIG. 3) to the base 30 of the support frame 20. The female member 80 is thus secured against rotation with respect to the support frame, and includes an enlarged boss 82 received axially over the frame shaft 62 in bearing engagement with the adjacent end of the third roller 16. The female member 80 includes internal threads for threadably receiving an externally threaded male member 84, or adjustment hub, which is also received axially over the frame shaft 62. Conveniently, this adjustment hub 84 includes a central boss 86 received over the shaft 62 and lined with an appropriate bushing 88. Pressed ears 90 are formed on the shaft 62 to provide an axial limit stop for the adjustment hub 84.

The adjustment hub 84 is movable axially along the frame shaft 62 by threadably shifting the hub 84 with respect to the female member 80. Importantly, between the female member 80 and the adjustment hub 84, a pin 92 extends laterally through the shaft 62. This pin 92 is receivable within opposed slots 94 in a retainer 96 received over the shaft 62. The retainer 96 is positioned on the shaft 62 between the boss 86 of the hub 84 and a plurality of alternating washers 97 and lock nuts 98 which are also received about the shaft 62.

As the adjustment hub 84 is threadably shifted along the shaft 62 toward the third roller 16, the lock nuts 98 progressively compress to apply a frictional resistance force between the boss 82 of the nonrotating female member, and the retainer 96 fixed for rotation with the frame shaft 62. Accordingly, a frictional resistance force is applied to the shaft 62 to resist rotational pivoting of the shaft with respect to the rollers. The magnitude of resistance to rotation of the shaft is directly related to the axial position of the adjustment hub 84 and the resultant compression of the lock washers 98. Conveniently, once the desired magnitude of frictional resistance is chosen, a set screw 99 or the like is provided for rotatably locking the female member 80 and the adjustment hub 84 against further rotation with respect to each other.

The application of a frictional force resisting rotational motion of the shaft 62 correspondingly resists pivoting motion of the handle member 22 with respect to the rollers. Thus, when paint is carried by the rollers, the friction clutch assembly 24 prevents free rotation with respect to the handle member 22 and thereby assures that the rollers are carried in a stable manner to reduce correspondingly user fatigue. Moreover, the friction clutch assembly 24 allows the necessary pivoting motion between the rollers and the handle member 22, as illustrated by arrow 100 in FIG. 4, to enable the user to maintain easily the assembly in proper rolling engagement with the surface 58 to be painted.

The invention thus provides an improved paint roller assembly 10 including multiple rollers 12 and 14 for rapid application of paint to a surface 58, and for achieving a finish surface texture with a minimum of strokes. The third roller 16 is positioned to eliminate substantially all paint splatter during use. The support frame may be constructed from aluminum or other suitable lightweight materials to provide an assembly which is lightweight and thus easy to use. The friction clutch assembly 24 substantially reduces user fatigue by stabilizing the rollers with respect to the handle member 22 for ease of proper engagement of the rollers 12 and 14 with a surface 58.

If desired, the small third roller 16 can be removed from the assembly, and used separately for painting in small areas, and for reaching behind radiators, water closets, and the like. That is, removal of the bracket 46 allows the third roller 16 to be removed from the shaft 62, and the frame shaft 62 to be withdrawn from the friction clutch assembly 24. Then reinstallation of the third roller 16 on the shaft 62 provides a single paint roller unit wherein the roller has a relatively small diameter. To this end, the adjustment hub 84 is chosen to have an outer diameter generally equal to or less than the diameter of the third roller 16 so as not to interfere when the roller is used in small areas apart from the larger roller 12 and 14.

A variety of modifications and improvements to the paint roller of this invention are believed to be apparent to one skilled in the art. For example, the large roller 12 can be formed to include a somewhat resilient cylinder 34 for improved coverage into a corner of a room. Accordingly, no limitation on the invention is intended, except as set forth in the appended claims.

What is claimed is:

1. A paint roller assembly, comprising:
a roller support frame;
a pair of rollers mounted on said frame in spaced parallel relation, and rotatable with respect to parallel axes for independent rolling contact with a surface to be painted;
a third roller mounted with respect to said frame generally at one side of said pair of rollers and in parallel rolling contact with both of said pair of rollers for distributing paint between said pair of rollers and for substantially eliminating splatter of paint from said pair of rollers;
a handle member pivotally mounted with respect to said frame; and
a friction clutch assembly mounted on said frame for applying an adjustable frictional force to resist pivoting motion of said handle member with respect to said frame for controllably stabilizing said pair of rollers with respect to said handle member.

2. A paint roller assembly as set forth in claim 1 wherein said pair of rollers comprises a first roller having a relatively large diameter, and a second roller having a comparatively smaller diameter, said third roller having a diameter less than the diameter of said second roller.

3. A paint roller assembly as set forth in claim 1 wherein said support frame comprises a generally U-shaped rod including a pair of parallel frame shafts interconnected at a common end by a frame base, said pair of rollers being mounted for rotation respectively about the axes of said parallel frame shafts.

4. A paint roller assembly as set forth in claim 3 wherein said frame further includes a third frame shaft positioned in parallel with said pair of frame shafts, said third roller being mounted for rotation about the axis of said third frame shaft.

5. A paint roller assembly as set forth in claim 4 wherein said third frame shaft is coupled with said handle member.

6. A paint roller assembly as set forth in claim 4 further including a bracket coupled to said pair of frame shafts and to said third frame shaft for maintaining said shafts in parallel relation with respect to each other.

7. A paint roller assembly as set forth in claim 4 including means for securing said pair of rollers and said third roller against axial excursions on their respective shafts.

8. A paint roller assembly as set forth in claim 4 further including a bracket coupled to said pair of frame shafts and to said third frame shaft for maintaining said shafts in parallel relation with respect to each other.

9. A paint roller assembly as set forth in claim 1 wherein said friction clutch assembly comprises a first threaded member secured against rotation on said frame, a second threaded member threadably engageable with said first member for movement with respect thereto, a retainer secured for pivotal motion along with said handle member, and adjustable friction means interposed between said retainer and said first threaded member, said friction means being for applying a friction force to said retainer to resist pivotal motion of said handle member with respect to said frame, said force being adjusted according to the relative position of said second threaded member with respect to said first threaded member.

10. A paint roller assembly as set forth in claim 9 including means for releasably locking said first and second threaded members against movement with respect to each other.

11. A paint roller assembly as set forth in claim 9 wherein said third roller is mounted for rotation on a frame shaft joined to said handle member and forming an axis of pivoting motion of said handle member, said first threaded member comprising a female member rotatably receiving said shaft and secured against rotation with respect to the portion of said support frame carrying said pair of rollers, said second threaded member comprising a male member rotatably received over said shaft in threaded engagement with said female member, said friction means comprising an alternating set of washers and lock washers received over said shaft between said retainer and said female member, said lock washers being progressively compressible upon appropriate movement of said male member with respect to said female member for applying an adjustable frictional force to said retainer.

12. A paint roller assembly as set forth in claim 11 wherein said male member has an outside diameter generally equal to or less than the outside diameter of said third roller.

13. A paint roller assembly as set forth in claim 9 including means for releasably locking said first and second threaded members against movement with respect to each other.

14. A paint roller assembly comprising:

a generally U-shaped rod having a pair of spaced parallel frame shafts interconnected at a common end by a frame base;

a first roller mounted on one of said frame shafts for rotation about the axis of said one frame shaft;

a second roller mounted on the other of said frame shafts for rotation about the axis of said other frame shaft in spaced parallel relation with said first roller, said first and second rollers being disposed for independent and simultaneous rolling contact with a surface to be painted;

a third frame shaft disposed in parallel with said pair of shafts generally at one side of a plane common to said pair of shafts;

a third roller mounted on said third shaft for rotation about the axis thereof in rolling contact with both of said first and second rollers for distributing paint between said first and second rollers and for substantially eliminating splatter of paint from said first and second rollers;

a handle member joined to said third shaft and pivotally movable about the axis of said third shaft;

a first threaded member fixed to said frame base and received about said third shaft;

a second threaded member rotatably received about said third shaft and axially movable in threaded engagement with said first threaded member;

a retainer disposed on said third shaft for rotation therewith between said first and second threaded members and in bearing engagement with said second threaded member; and compression means received on said third shaft between said retainer and said first threaded member, said compression means reacting between said retainer and said first threaded member to apply a friction force to said retainer in accordance with the axial position of said second threaded member, said friction force resisting pivoting motion of said handle member with respect to said first and second rollers for controllably stabilizing said first and second rollers with respect to said handle member.

15. A paint roller assembly as set forth in claim 14 including means for securing said first, second, and third rollers against axial excursions on their respective shafts.

* * * * *